US006644508B2

(12) United States Patent
Haskayne et al.

(10) Patent No.: US 6,644,508 B2
(45) Date of Patent: Nov. 11, 2003

(54) BEVERAGE DISPENSER

(75) Inventors: Paul Haskayne, Adelaide (AU); John T. Hawkins, Jr., Adkins, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 10/246,803

(22) Filed: Sep. 18, 2002

(65) Prior Publication Data

US 2003/0071060 A1 Apr. 17, 2003

Related U.S. Application Data

(60) Provisional application No. 60/324,150, filed on Sep. 20, 2001.

(51) Int. Cl.[7] ..... B67D 5/56

(52) U.S. Cl. ..... 222/54; 222/63; 222/129.1; 222/129.2; 222/146.6; 222/1

(58) Field of Search ..... 222/54, 63, 129.1, 222/129.2, 129.3, 129.4, 146.6, 1

(56) References Cited

U.S. PATENT DOCUMENTS 4,034,897 A * 7/1977 Brown ..... 222/146.6
4,304,736 A * 12/1981 McMillin et al. ..... 222/129.1
4,687,120 A * 8/1987 McMillin ..... 222/129.1
4,993,593 A * 2/1991 Fabiano et al. ..... 222/146.5
5,115,956 A * 5/1992 Kirschner et al. ..... 222/129.1
5,556,006 A * 9/1996 Sano ..... 222/129.1
6,216,913 B1 * 4/2001 Bilskie et al. ..... 222/129.2

* cited by examiner

*Primary Examiner*—Kenneth Bomberg
(74) *Attorney, Agent, or Firm*—Christopher L. Makay

(57) ABSTRACT

A dispenser system includes a product source, a cooling unit, an agitator, a dispensing station coupled with the product source, a sensor, and a controller. The cooling unit cools product delivered to the dispensing station from the product source. The agitator is disposed in the cooling unit and circulates cooling fluid contained in the cooling unit. The sensor measures an operating parameter of the dispenser system and outputs a signal representative thereof. The controller, responsive to the signal output by the sensor, operates the agitator at a lower speed when the signal output by the sensor indicates the dispenser system is operating in a desired stable state. Alternatively, the controller, responsive to the signal output by the sensor, operates the agitator at a higher speed when the signal output by the sensor indicates the dispenser system is not operating in the desired stable state.

21 Claims, 4 Drawing Sheets

BEVERAGE DISPENSER

This application claims the benefit of Provisional Application No. 60/324,150, filed Sep. 20, 2001.

BACKGROUND OF THE INVENTION

1. Field of the Invention

The present invention relates to an apparatus for dispensing one or more chilled products, and more particularly, but not by way of limitation, to an apparatus for dispensing one or more chilled products under a desired pressure and temperature.

2. Description of the Related Art

Certain dispenser units employ a python connecting a dispensing tower some distance from a cooling unit to dispense products. These dispenser units are valuable to businesses with limited counter space because only the dispensing tower must be placed on the counter top, as opposed to other dispenser units where the cooling unit, including pumps and a carbonator, are placed on the counter top along with the dispensing tower. A disadvantage of remote dispensing towers however is poor still water dispense rates at a dispensing valve caused through insufficient flow pressure from still water sources, and solution of this problem through the use of a dedicated pump is not practical due to prohibitive cost factors.

Regardless of whether a remote dispensing tower is utilized, consistently delivering a product at a desired temperature is an important concern. In the case of a carbonated product, if the temperature of the delivered product rises above 40° F., excessive foaming can occur, leading to an overflow of the receiving container and often a spill that must be cleaned by either the recipient or a paid employee. Both options are undesirable, since the employee must forego other tasks, or worse, an unexpected stain makes a customer upset. Worst of all however is a customer slipping and falling on the overflowed carbonated product leading to injury and possible legal action. Therefore, it is important to dispense products at a desired temperature.

Consistently delivering a product at a desired temperature involves achieving optimal heat transfer from the product to a cooling unit, which typically is a refrigeration unit and associated cooling chamber having a cooling fluid and a frozen cooling fluid bank therein. Optimal heat transfer is enhanced through vigorous circulation of cooling fluid about the frozen cooling fluid bank. Unfortunately, vigorous circulation suffers several disadvantages. Running an agitator continually at a high speed is not cost effective, and vigorous agitation detrimentally affects both the weight and the shape of the cooling fluid bank, which in fact decreases heat transfer.

Accordingly, there has been a long felt need for a dispenser system providing agitation that enhances heat transfer from a product as well as a cost-effective still water boost.

SUMMARY OF THE INVENTION

In accordance with the present invention, a dispenser system includes a beverage syrup source, a pump connected with a plain water source, a carbonator, a cooling unit, an agitator, a dispensing station, a sensor, and a controller. The carbonator connects with a source of carbon dioxide gas and with the pump to produce carbonated water. The cooling unit cools the beverage syrup delivered from the beverage syrup source and the plain water delivered from the pump. The agitator is disposed in the cooling unit to circulate cooling fluid contained within the cooling unit. The dispensing station connects with the beverage syrup source, the pump, and the carbonator, whereby the dispensing station combines either beverage syrup and plain water to produce a non-carbonated dispensed product or beverage syrup and carbonated water to produce a carbonated dispensed product. The sensor measures an operating parameter of the dispenser system and outputs a signal representative thereof. The controller, responsive to the signal output by the sensor, operates the agitator at a lower speed when the signal output by the sensor indicates the dispenser system is operating in a desired stable state. Alternatively, the controller, responsive to the signal output by the sensor, operates the agitator at a higher speed when the signal output by the sensor indicates the dispenser system is not operating in the desired stable state.

An operating parameter measured by the sensor includes the temperature of the cooling fluid within the cooling unit. Consequently, the controller operates the agitator at a lower speed when the signal output by the sensor indicates the temperature of the cooling fluid within the cooling unit is below a desired low temperature. Further, the controller operates the agitator at a higher speed when the signal output by the sensor indicates the temperature of the cooling fluid within the cooling unit is above a desired low temperature.

An operating parameter measured by the sensor includes whether a valve on the dispensing station has been activated. Consequently, the controller operates the agitator at a lower speed when the signal output by the sensor indicates no valve on the dispensing station has been activated. Further, the controller operates the agitator at a higher speed when the signal output by the sensor indicates a valve on the dispensing station has been activated.

An operating parameter measured by the sensor includes the level of carbonated water in the carbonator. Consequently, the controller normally operates the agitator at a lower speed. However, the controller operates the agitator at a higher speed for a preset time period when the signal output by the sensor indicates the carbonator is not full.

The cooling unit includes a refrigeration unit, a cooling chamber having therein a cooling fluid and a frozen cooling fluid bank formed by the refrigeration unit, and a cooling coil disposed in the cooling chamber and coupled at an inlet with the beverage syrup source and at an outlet with the dispensing station. The cooling unit further includes a cooling coil disposed in the cooling chamber and coupled at an inlet with the water source and at an outlet with the carbonator. The cooling unit still further includes a cooling coil disposed in the cooling chamber and coupled at an inlet with the carbonator and at an outlet with the dispensing station.

It is therefore an object of the present invention to control agitation of a cooling fluid contained within a cooling unit of a dispenser system responsive to operating parameters of the dispenser system.

It is a further object of the present invention to provide a dispenser system with a pump that supplies plain water to both a carbonator of the dispenser system and a dispensing station of the dispenser system.

Still other objects, features, and advantages of the present invention will become evident to those of ordinary skill in the art in light of the following.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of the ordinary skill in the art will recognize many alternative embodiments, especially in light of the illustrations provided herein, this detailed description is exemplary of the preferred embodiment of the present invention, the scope of which is only limited by the claims appended hereto.

Figure 1:
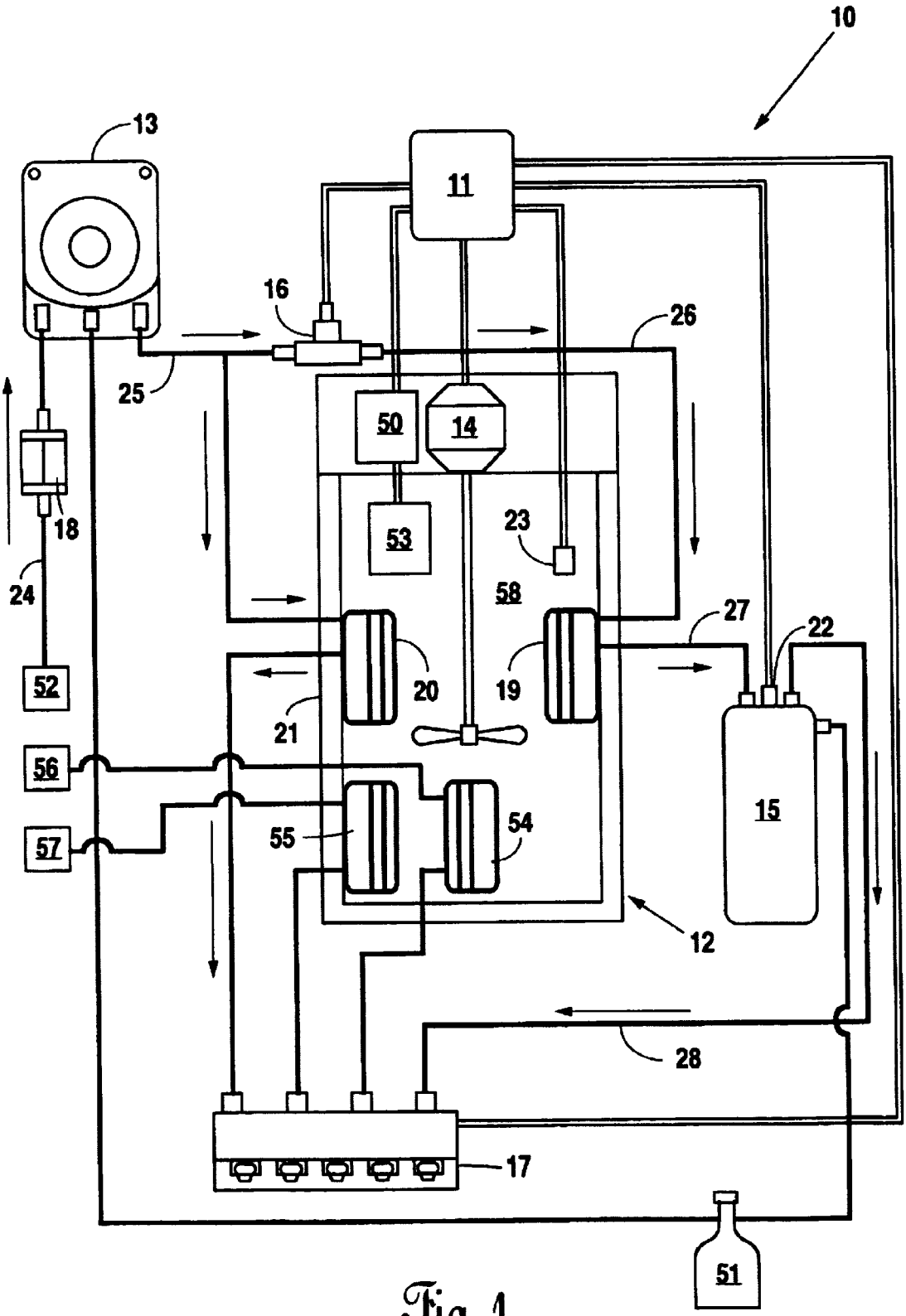
FIG. 1 is an illustrative diagram of the preferred embodiment of a dispenser system.

Referring now to the FIG. 1, a dispenser system 10 includes a controller 11, a cooling unit 12, a pump 13, an agitator 14, a carbonator 15, a solenoid valve 16, a dispensing station 17, and a backflow preventor 18. The cooling unit 12 is a well-known type and includes cooling coils 19, 20, 54, and 55; a refrigeration unit 50; and a coaling chamber 21 having therein a cooling fluid 58 and a frozen cooling fluid bank 53 formed by the refrigeration unit 50.

The controller 11 operatively links with a level sensor 22 of the carbonator 15, a cooling fluid temperature sensor 23, the dispensing station 17, the pump 13, the solenoid valve 16, and the agitator 14. In this preferred embodiment the controller 11 is preferably any suitable microprocessor and associated circuitry, although those of ordinary skill in the art will recognize many other suitable types of controllers.

the dispenser system 10 includes the carbonator 15 to produce carbonated water, which is combined with a flavored syrup at the dispensing station 17 to form a dispensed product. Accordingly, the carbonator 15 connects to a source of carbon dioxide gas 51 and to a source of water 52.

The dispenser system 10 includes the pump 13 to deliver the required water to the carbonator 15. In this preferred embodiment the pump 13 is preferably a carbon dioxide gas powered pump and more preferably a FLOJET™ 5800 carbon dioxide gas powered pump. The pump 13 connects to the same source of carbon dioxide gas as the carbonator 15, which then provides the force for driving the pump 13. Employing the same source 51 to supply the carbon dioxide gas to the carbonator 15 as well as drive the pump 13 provides cost savings in both manufacturing and operating the dispenser system 10. Nevertheless, those of ordinary skill in the art will recognize that other gases could be employed or other comparable pumps.

Responsive to a signal from the level sensor 22 indicating the carbonator 15 requires replenishment of water, the controller 11 opens the solenoid valve 16 to permit the pump 13 to deliver water into the carbonator 15. The pump 13 draws water from a water source 52 through a source line 24 and the backflow preventor 18. A line 25 delivers the water through the open solenoid valve 16, whereupon a line 26 delivers the water to the cooling coil 19. The position of the cooling coil 19 within the cooling chamber 21 facilitates the transfer of heat from the water to the frozen cooling fluid bank via the cooling fluid. A line 27 then delivers the cooled water into the carbonator 15.

Responsive to a signal from the level sensor 22 indicating the carbonator 15 is full, the controller 11 closes the solenoid valve 16 to prevent the pump 13 from delivering water into the carbonator 15. A safety feature of the dispenser system 20 includes the use of a carbon dioxide gas powered pump. In the event the solenoid valve does not close, the pump 13 eventually stalls without damage when the driving force of the carbon dioxide gas equals the pressure within the carbonator 15.

Carbon dioxide gas introduced into the carbonator 15 mixes with the cooled water therein to form carbonated water ready for mixture with any number of flavored syrups independently delivered to the dispensing station 17. The dispensing station 17 in this preferred embodiment is a remote dispensing tower including a plurality of dispensing valves thereon. Upon the activation of a dispensing valve configured for the dispensing of a carbonated product, the carbonator 15 releases carbonated water into a line 28 connected to the dispensing station 17. The carbonated water flows from the line 28 into the activated dispensing valve of the dispensing station 17. Likewise, a flavored syrup source 56 delivers a flavored syrup via cooling coil 54 to the same activated dispensing valve, which mixes the flavored syrup with the carbonated water to form a dispensed carbonated product. Alternatively, a product source 57 delivers a product via the cooling coil 55 to a dispensing valve of the dispensing station 17. Likewise, a flavored syrup source delivers a flavored syrup to the same activated dispensing valve, which mixes the flavored syrup with the carbonated water to form a dispensed carbonated product.

Based upon customer preferences, the dispensing station 17 will include any number of dispensing valves configured for the dispensing of non-carbonated product. Accordingly, the dispenser system 10 further includes the pump 13 to provide a still water pressure boost because many standard water supplies operate at pressures insufficient for a properly dispensed non-carbonated product.

The pump 13 draws water from the water source through a source line 24 and the backflow preventor 18, whereupon a line 29 delivers the water to the cooling coil 20. The position of the cooling coil 20 within the cooling chamber 21 facilitates the transfer of heat from the water to the frozen cooling fluid bank via the cooling fluid. A line 30 then delivers the cooled water to the dispensing station 17. Upon the activation of a dispensing valve configured for the dispensing of a non-carbonated product, water flows from the line 30 into the activated dispensing valve of the dispensing station 17. Likewise, a flavored syrup source delivers a flavored syrup to the same activated dispensing valve, which mixes the flavored syrup with the water to form a dispensed non-carbonated product.

As long as the pressure within the lines 29 and 30 and the cooling coil 20 remains below the driving force of the carbon dioxide gas, the pump 13 continues to deliver water to the dispensing station 17. However, when the pressure within the lines 29 and 30 and the cooling coil 20 reaches the driving force of the carbon dioxide gas, the pump 13 stalls without damage. Consequently, the pump 13 provides a still water pressure boost without the added cost of a dedicated still water pressure boost pump.

The dispenser system 10 further includes the controller 11 to regulate the agitator 14 so as to achieve optimal heat transfer to the cooling unit 12 from product, whether water, carbonated water, or flavored syrup. To achieve this optimal heat transfer, the controller 11 regulates the speed of the agitator in accordance with operating parameters of the dispenser system 10, such as carbonator level, cooling fluid temperature, valve activation, and the like. It should be understood that the above are merely exemplary of the various operating parameters of the dispenser system 10 and are not to be considered limiting.

Figure 3:
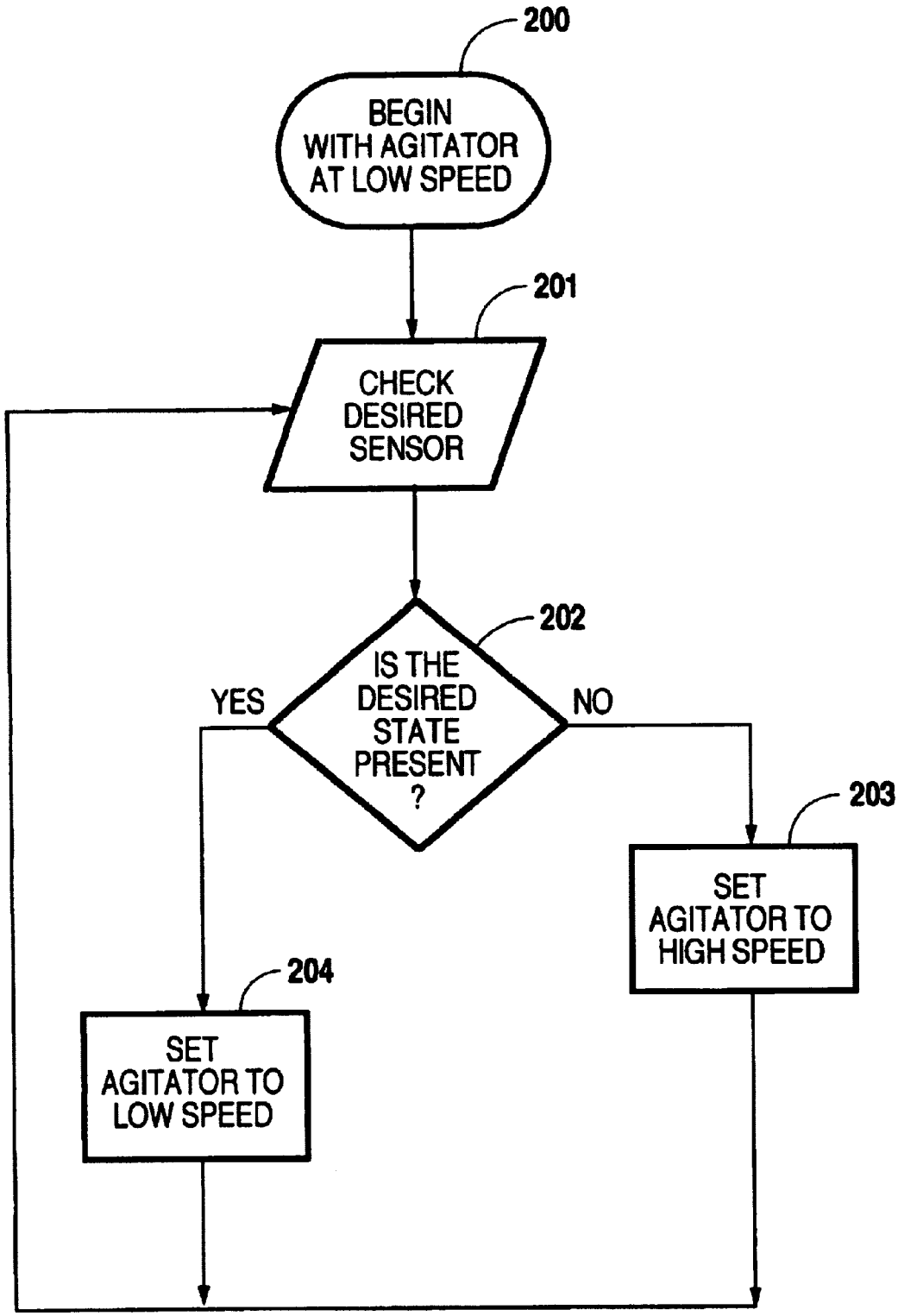
FIG. 3 is an illustrative flow chart of the operation of a controller.

Referring now to FIG. 3, the controller 11 begins in step 200 by running the agitator at a low speed, which is cost-effective and produces a stabile weighted and shaped frozen cooling fluid bank. In step 201, the controller reads a signal from a desired sensor, such as the cooling fluid temperature sensor 23 or a valve activation sensor of the dispensing station 17. The controller 11 in step 201 then determines if the dispenser system 10 is functioning in a desired stable state. Illustratively, a desired stable state would include the condition where the cooling fluid resides at or below a desired optimal low temperature or no valves on the dispensing station 17 have been activated.

If the controller 11 determines that a desired stable state does not exist (e.g., the cooling fluid resides above a desired optimal low temperature or a valve or valves on the dispensing station 17 have been activated), it proceeds to step 203 and runs the agitator at a high speed. By operating the agitator 14 at higher speeds under certain conditions, the dispenser system 10 provides a vigorous agitation of the cooling fluid that optimizes heat transfer from product without detrimentally affecting the weight and shape stability of the frozen cooling fluid bank.

The controller 11 then returns to step 201 and reads a signal from the desired sensor before proceeding to step 202 to determine if the dispenser system 10 is functioning in a desired stable state. As long as the controller 11 determines the dispenser system 10 is not functioning in a desired stable state, it maintains the agitator 14 operating at a high speed. However, if in step 202 the controller 11 determines the dispenser system 10 is functioning in a desired stable state, it proceeds to step 204 and returns the agitator 14 to its low speed before executing step 201.

Figure 4:
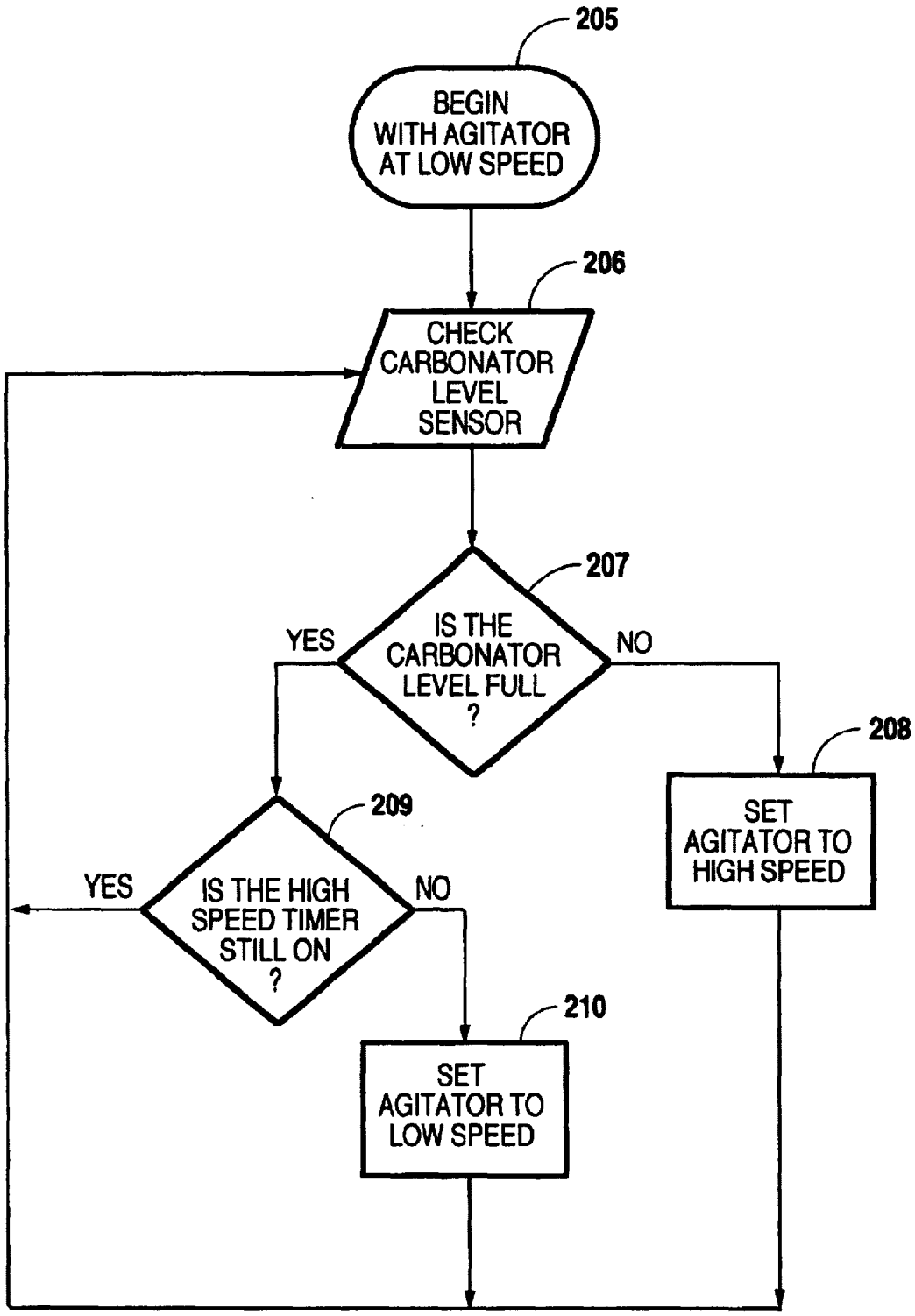
FIG. 4 is an illustrative flow chart of the operation of a controller.

Referring now to FIG. 4, the controller 11 begins in step 205 by running the agitator at a low speed, which is cost-effective and produces a stabile weighted and shaped frozen cooling fluid bank. In step 206, the controller reads a signal from the level sensor 22 of the carbonator 15. The controller 11 in step 207 then determines if the carbonator 15 is full.

If the controller 11 determines the carbonator 15 is not full, it proceeds to step 208 and runs the agitator at a high speed. The controller 11 also begins a high-speed timer that controls the length of time the agitator 14 operates at its high speed. By operating the agitator 14 at higher speeds under certain conditions, the dispenser system 10 provides a vigorous agitation of the cooling fluid that optimizes heat transfer from product without detrimentally affecting the weight and shape stability of the frozen cooling fluid bank.

The controller 11 then returns to step 206 and reads a signal from the level sensor 22 of the carbonator 15. As long as the controller 11 determines the carbonator 15 is not full, it maintains the agitator 14 operating at a high speed. However, if in step 207 the controller 11 determines the carbonator 15 is full, it proceeds to step 209 and determines if the high-speed timer has timed out.

As long as the high-speed timer has not timed out, the controller 11 returns to step 206 and reads a signal from the level sensor 22 of the carbonator 15. If the controller 11 in step 207 determines the carbonator 15 is still full, it again returns to step 209. When the controller in step 209 determines the high-speed timer has timed out, it proceeds to step 210 and returns the agitator 14 to its low speed before executing step 206.

Figure 2:
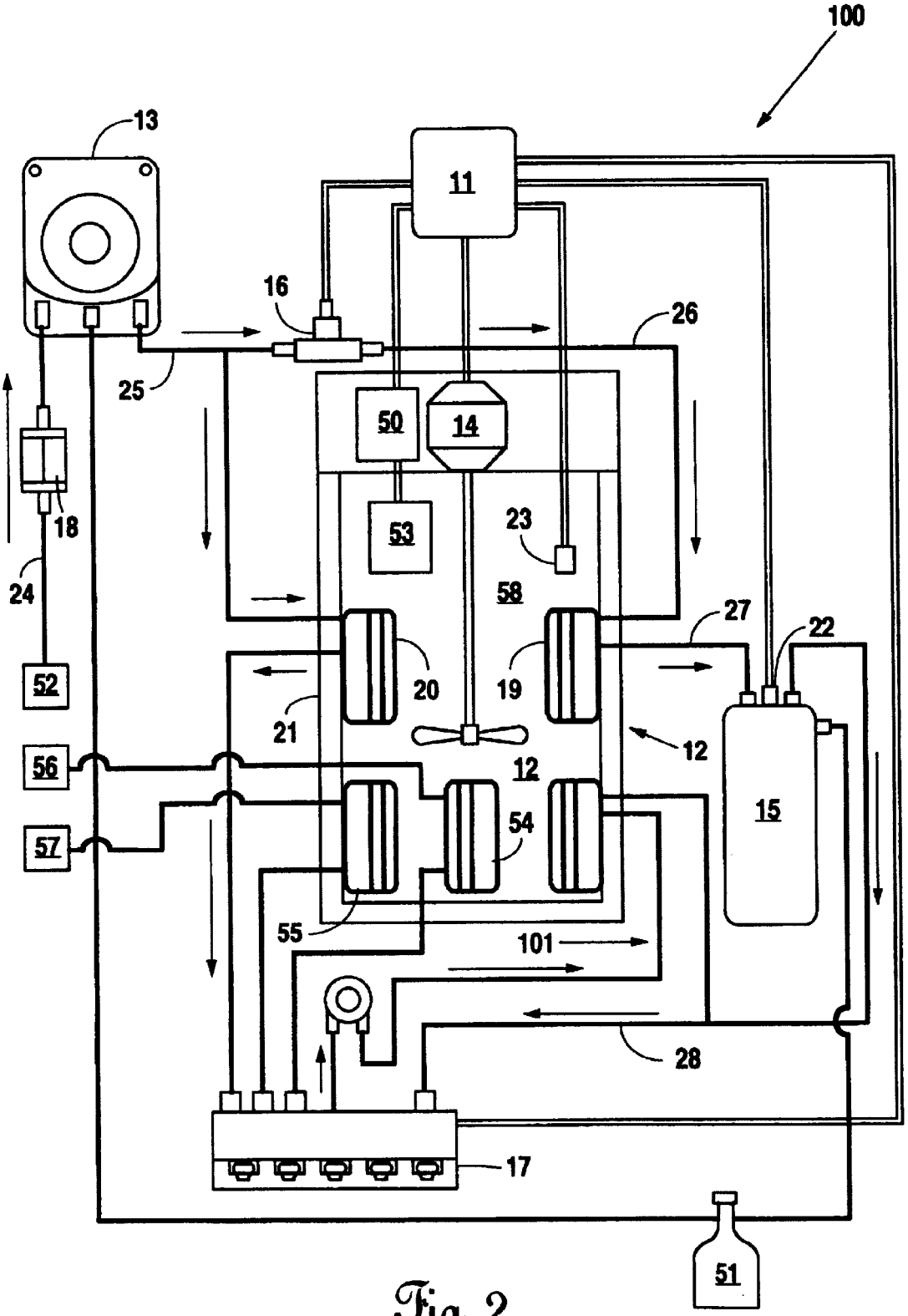
FIG. 2 is an illustrative diagram of an alternative embodiment of the dispenser system.

Referring now to the FIG. 2, a dispenser system 100 is identical to the dispenser system 10, except the dispenser system 100 includes a carbonated water recirculation system 101, which is well-known to those of ordinary skill in the art.

While the foregoing description is exemplary of the preferred embodiment of the present invention, those of ordinary skill in the relevant art will recognize the many variations, alterations, modifications, substitutions and the like as are readily possible, especially in light of this description, the accompanying drawings and claims drawn thereto.

What is claimed is:

1. A dispenser system, comprising:

a product source;

a cooling unit that cools product delivered from the product source;

an agitator disposed in the cooling unit wherein the agitator circulates cooling fluid contained in the cooling unit;

a dispensing station coupled with the product source;

a sensor that measures an operating parameter of the dispenser system and outputs a signal representative thereof; and a controller that monitors the signal output by the sensor, whereby the controller operates the agitator at a lower speed when the signal output by the sensor indicates the dispenser system is operating in a desired stable state, and further whereby the controller operates the agitator at a higher speed when the signal output by the sensor indicates the dispenser system is not operating in the desired stable state.

2. The dispenser system according to claim 1, wherein an operating parameter measured by the sensor includes temperature of the cooling fluid within the cooling unit.

3. The dispenser system according to claim 2, whereby the controller operates the agitator at a lower speed when the signal output by the sensor indicates the temperature of the cooling fluid within the cooling unit is below a desired low temperature, and further whereby the controller operates the agitator at a higher speed when the signal output by the sensor indicates the temperature of the cooling fluid within the cooling unit is above a desired low temperature.

4. The dispenser system according to claim 1, wherein an operating parameter measured by the sensor includes whether a valve on the dispensing station has been activated.

5. The dispenser system according to claim 4, whereby the controller operates the agitator at a lower speed when the signal output by the sensor indicates no valve on the dispensing station has been activated, and further whereby the controller operates the agitator at a higher speed when the signal output by the sensor indicates a valve on the dispensing station has been activated.

6. The dispenser system according to claim 1, wherein the cooling unit comprises:

a refrigeration unit;

a cooling chamber having therein the cooling fluid and a frozen cooling fluid bank formed by the refrigeration unit; and a cooling coil disposed in the cooling chamber and coupled at an inlet with the product source and at an outlet with the dispensing station.

7. A dispenser system, comprising:

a beverage syrup source;

a carbonator coupled to a source of carbon dioxide gas and to a water source to produce carbonated water;

a cooling unit that cools beverage syrup delivered from the beverage syrup source;

an agitator disposed in the cooling unit wherein the agitator circulates cooling fluid contained within the cooling unit;

a dispensing station coupled with the beverage syrup source and the carbonator, whereby the dispensing station combines the beverage syrup and the carbonated water to produce a dispensed product;

a sensor that measures an operating parameter of the dispenser system and outputs a signal representative thereof; and a controller that monitors the signal output by the sensor, whereby the controller operates the agitator at a lower speed when the signal output by the sensor indicates the dispenser system is operating in a desired stable state, and further whereby the controller operates the agitator at a higher speed when the signal output by the sensor indicates the dispenser system is not operating in the desired stable state.

8. The dispenser system according to claim 7, wherein the cooling unit cools water from the water source prior to delivery of the water to the carbonator.

9. The dispenser system according to claim 7, wherein the cooling unit cools carbonated water from the carbonator prior to delivery of the carbonated water to the dispensing station.

10. The dispenser system according to claim 7, wherein the sensor measures the level of carbonated water in the carbonator.

11. The dispenser system according to claim 7, whereby the controller normally operates the agitator at a lower speed, and further whereby the controller operates the agitator at a higher speed for a preset time period when the signal output by the sensor indicates the carbonator is not full.

12. The dispenser system according to claim 7, wherein the cooling unit comprises:

a refrigeration unit;

a cooling chamber having therein the cooling fluid and a frozen cooling fluid bank formed by the refrigeration unit; and a cooling coil disposed in the cooling chamber and coupled at an inlet with the beverage syrup source and at an outlet with the dispensing station.

13. The dispenser system according to claim 12, wherein the cooling unit comprises a cooling coil disposed in the cooling chamber and coupled at an inlet with the water source and at an outlet with the carbonator.

14. The dispenser system according to claim 12, wherein the cooling unit comprises a cooling coil disposed in the cooling chamber and coupled at an inlet with the carbonator and at an outlet with the dispensing station.

15. A method of controlling a dispenser system, comprising:

providing an agitator operated to circulate cooling fluid contained in a cooling unit of the dispenser system;

measuring an operating parameter of the dispenser system;

outputting a signal representative thereof;

operating the agitator at a lower speed when the signal output by the sensor indicates the dispenser system is operating in a desired stable state; and operating the agitator at a higher speed when the signal output by the sensor indicates the dispenser system is not operating in the desired stable state.

16. The method of controlling a dispenser system according to claim 15, wherein measuring an operating parameter of the dispenser system comprises measuring temperature of a cooling fluid within the dispenser system.

17. The method of controlling a dispenser system according to claim 16, wherein operating an agitator, comprises:

operating the agitator at a lower speed when the signal indicates the temperature of the cooling fluid within the dispenser system is below a desired low temperature; and operating the agitator at a higher speed when the signal indicates the temperature of the cooling fluid within the dispenser system is above a desired low temperature.

18. The method of controlling a dispenser system according to claim 15, wherein measuring an operating parameter of the dispenser system comprises measuring whether a valve on of the dispenser system has been activated.

19. The method of controlling a dispenser system according to claim 18, wherein operating an agitator, comprises:

operating the agitator at a lower speed when the signal indicates no valve of the dispenser system has been activated; and operating the agitator at a higher speed when the signal indicates a valve of the dispenser system has been activated.

20. The method of controlling a dispenser system according to claim 15, wherein measuring an operating parameter of the dispenser system comprises measuring the level of carbonated water within a carbonator of the dispenser system.

21. The method of controlling a dispenser system according to claim 20, wherein operating an agitator, comprises:

normally operating the agitator at a lower speed; and operating the agitator at a higher speed for a preset time period when the signal indicates the carbonator is not full.

* * * * *